US007316038B2

(12) United States Patent
Egeresi

(10) Patent No.: US 7,316,038 B2
(45) Date of Patent: Jan. 8, 2008

(54) TOILET ODOR BLOCKING AND BIDET SYSTEM WITH WATER INLINE T-ADAPTER

(76) Inventor: Zoltan Egeresi, 5500 Coast Rd., Santa Cruz, CA (US) 95060

( * ) Notice: Subject to any disclaimer, the term of this patent is extended or adjusted under 35 U.S.C. 154(b) by 0 days.

(21) Appl. No.: 10/804,599

(22) Filed: Mar. 19, 2004

(65) Prior Publication Data

US 2004/0181865 A1 Sep. 23, 2004

(51) Int. Cl.

| | |
|---|---|
| ***A47K 3/20*** | (2006.01) |
| ***A47K 4/00*** | (2006.01) |
| ***E03D 9/02*** | (2006.01) |

(52) U.S. Cl. ..... 4/420.4; 4/443; 4/448; 4/661; 4/223

(58) Field of Classification Search ..... 4/420.1–420.5, 4/443, 444, 447, 448, 220, 223, 224, 661; 422/5, 122; 424/76.5, 76.6

See application file for complete search history.

(56) References Cited

U.S. PATENT DOCUMENTS

| | | | | | |
|---|---|---|---|---|---|
| 3,762,875 | A | * | 10/1973 | Burmeister | 422/5 |
| 4,242,764 | A | * | 1/1981 | Fukuda | 4/420.4 |
| 5,277,226 | A | * | 1/1994 | Kuhlman | 137/862 |
| 5,958,334 | A | * | 9/1999 | Haddon | 422/5 |
| 5,987,659 | A | * | 11/1999 | Cannizzaro | 4/420.2 |
| 6,029,286 | A | * | 2/2000 | Funk | 4/223 |
| 6,105,179 | A | * | 8/2000 | Burns | 4/420.4 |

FOREIGN PATENT DOCUMENTS

WO WO 8706289 A2 * 10/1987

* cited by examiner

*Primary Examiner*—Tuan Nguyen

(57) ABSTRACT

An apparatus preventing odor from escaping the toilet bowl by generating a stream of bubbles to cover human waste by using liquid soap, air pump, and low volume water flow. The same system with higher water volume functions as a toilet bidet by using an elevated nozzle attached to the bubble dispensing tube. An additional component of the apparatus is a novel water inline adapter providing an extra, convenient way to create an additional easy water source for the stream of bubbles and the toilet bidet.

4 Claims, 6 Drawing Sheets

TOILET ODOR BLOCKING AND BIDET SYSTEM WITH WATER INLINE T-ADAPTER

BACKGROUND OF THE INVENTION

1. Field of Invention

This invention relates to Toilet Odor Blocking, Toilet Bidet and Water in-Line Adapter. It creates a continuous stream of bubbles by using small air compressor, water and liquid soap, the same bubble dispenser line with higher water pressure becomes a low cost Toilet Bidet system and the invention uses a special in-line water T adapter with male/female ballack threading connecting to the toilet tank valve for easy installation.

The newer toilets in most countries are water saving low flush types. The human waste in the toilet bowl is exposed with less water in the bowl and creates an even greater need for a workable, low cost odor blocking or odor venting system for toilets.

There are several innovations dealing with this kind of problem hardly any of them is on the market due to being a cumbersome or impractical or expensive design with many parts. Chemical odor control for indoor toilet consists mostly as blue tablets in the tank (sold under the trade name Vanish (or similar chemical liquids), it is a partial odor control at best, active odor control ingredients get diluted fast and it is fairly costly to maintain the required chemical concentration. Odor filled air should leave the toilet bowl before it reaches the ceiling fan or permeates the surrounding area or odor should be blocked before it escapes from the toilet bowl. My invention creates a continuous stream of bubbles as an odor-blocking barrier using domestic water source, liquid soap, small air compressor and mixing pipe, dual function bubble dispensing/bidet adapter has dual functions serving also as a Bidet adapter, and a T adapter providing a convenient connection to the toilet valve.

2. Description of Prior Art

Odor blocking as Funk teaches in U.S. Pat. No. 6,029,296 uses a small pressurized chemical can for delivering an odor reducing chemical to a toilet bowl with spray nozzle, no mention of how often these pressurized can would last or the frequency it needs to be replaced.

Haddon in U.S. Pat. No. 5,958,334 describes an odor trapping system, using many different kind of chemicals and some foam is created purely by these chemical reactions.

Burmeister's patent U.S. Pat. No. 3,762,875, Odor sealing method describes a chemically created foam with several mixture formulas to be sprayed into the toilet bowl by compressed air creating the dense foam barrier. Chemical agents like alcohol, sulfates, fatty acids, perfume etc are used, but it is a costly mixture for daily use in an average home.

Conrad's foreign German patent DE W00087/06289A2 (PCT/EP87/00178) of Oct. 22, 1987 teaches a Process and System for using a pedestal toilet, urinal and similar whereby prior to deposition of excrement, a layer of foam is produced and pumped into the bowl area from the foam storage. This system has two chambers; one foam mixer using concentrated chemical, and the second chamber is for foam storage, so it needs two liquid pumps running on electricity, wires are submerged creating potential electrocution hazard. The chambers as the patent describes it, are part of the toilet tank, thereby reducing the tank's flushing water capacity. This patent generally relates to foam introduction into the bowl area by foot pumps, by bulky hair dryer type blower, or using a system of tubes embedded into the toilet seat or toilet lid. The foam generated by this system as is generally dense.

Burns in U.S. Pat. No. 6,105,179 shows a toilet seat bidet with a pivotable water conduit with a spring and a positioning handle.

Kuhlman in U.S. Pat. No. 5,277,226 created a water line adapter for providing additional water source for kitchen appliances. This adapter is very useful in many cases it connects to an already installed shut off water valves, which are mostly compression type fittings.

Prior Art Cited by Examiner: Cannizaro, Carl C. U.S. Pat. No. 5,987,659A shows an external hand held shower used as a bidet.

BRIEF SUMMARY OF THE INVENTION

This is low cost Toilet Odor Blocking System with Bidet function and a water in-line Bullcock threaded T adapter blocking the odor evaporation from the human waste by covering it with continuous stream of scented soap bubbles. This air bubbler system can be attached to any standard tank type factory installed or after sales installation, it can use pre-mixed soapy solution or pressured water to mix it with liquid soap to create the bubbles with an adjustable air pump. The object of this function invention is create a universally adoptable inexpensive odor blocking system for indoor toilets without using expensive chemicals or ventilation systems. The same bubble dispensing adapter is used as a bidet adapter with higher water pressure. Operating cost is very low, the system uses about 100 drops of water with 5-10 drops of liquid soap in bubbler modem, 1-2 fl.oz. water/minute. The bubble dispenser line is attached around and below the rim of the toilet bowl (or attached under the toilet lid), it has 5-10 small ½ mm holes to create the bubbles with low pressure to cover the human waste, blocking odor. The bubble dispenser line has a small shower head at the end at the front end of the toilet bowl, with increased water pressure the bubble dispensing line becomes a bidet. Uninterrupted water source for the bidet is coming from the Ballcock threaded type toilet valve water line adapter, or diverted limited water supply as the bowl filler water from the toilet valve after flushing which normally channeled into the over flow pipe.

DETAILED DESCRIPTION OF THE INVENTION

Figure 1:
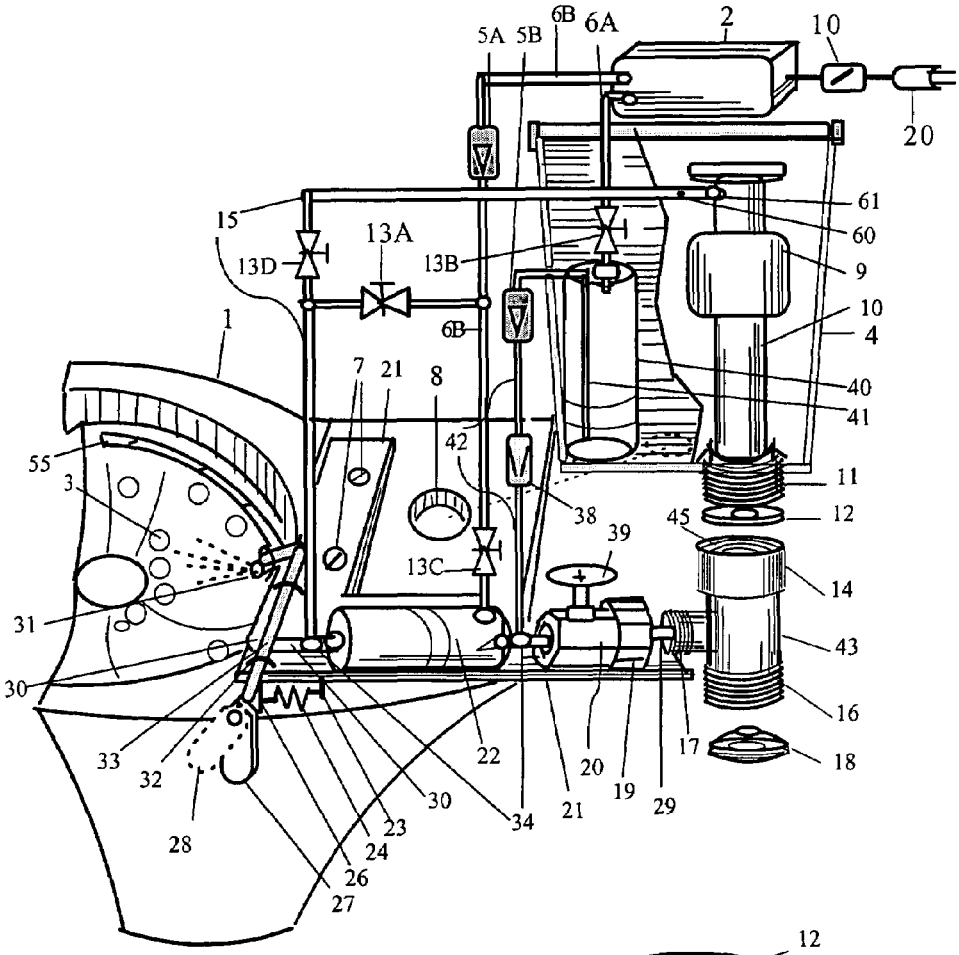
FIG. 1 on sheet one of the drawing pages show side perspective view of a toilet bowl (1) with water tank(4), air pump (2), liquid soap container (40), mixer tube (22), adjustable valves (13) check valves (5), compression type needle valve providing continuous water source (20) for bubble making and for bidet use, T connector (43) with bullcock threading, bubble dispensing line (30), pivoting bidet arm (27), short burst bidet water source (15).

This invention on FIG. 1 sheet one is a new art, low cost odor blocking system as it produces a stream of bubbles to cover the human waste with a dual new a method by using a dispenser/bidet tube (55). There are two ways to provide water for the bidet use: a partially diverted toilet tank water hose (15) for a short rinse as a new method, or a new art bullcock type threaded in-line T connector (43) with a preferred compression fitting for the bubbler function (slow flow, like fast dripping) and higher water flow for the bidet function.

For an easier understanding of this invention, FIG. 1 shows a system setup/perspective view, but most of the actual components can be located in the side, behind or below of the toilet tank, where only the bidet adapter's handle(27), ¼" flexible hose (30), water valve (20) and air pump on/off switch (10) need to be more accessible preventing any clutter.

FIG. 1 on sheet one of the drawing pages show the side perspective view of a toilet bowl (1) with water tank (4) separated, air pump (2) with on/off switch (10), AC plug (20), liquid soap container (40), mixer tube (22), adjustable valves (13) check valves (5), compression type needle valve providing continuous water source (20) for bubble making and for bidet use. T connector (43) with bullcock threading, bubble dispensing line (30), pivoting bidet arm in normal (27) and in bidet activated position (28), short burst bidet water source (15) with valve (13D) bringing water to the pivotable bidet head (31), flushing water from tank (4) connects to bowl (1) at flushing inlet (8), supporting bracket (21) is held up by lid screws (7).

The odor blocking bubble-making function is as follows: The air pump (2) is plugged in by plug (20) is turned on by switch (10), air hose (6A) connects to an adjustable valve (13B) to adjust air pressure channeled into the liquid soap container (40).

Air in line (6B) flows to check valve (5A) than trough adjusting valve (13C) into the mixing tube (22) to mix and expel the soapy water into bubbler/bidet adapter (55) via connecting hose (30). Extra air is introduced from the same air hose via (13A) valve after the soapy water is pushed out from mixing tube (22) to further increase the bubble content as they exit in the bubbler adapter outlets (35).

Figure 3:
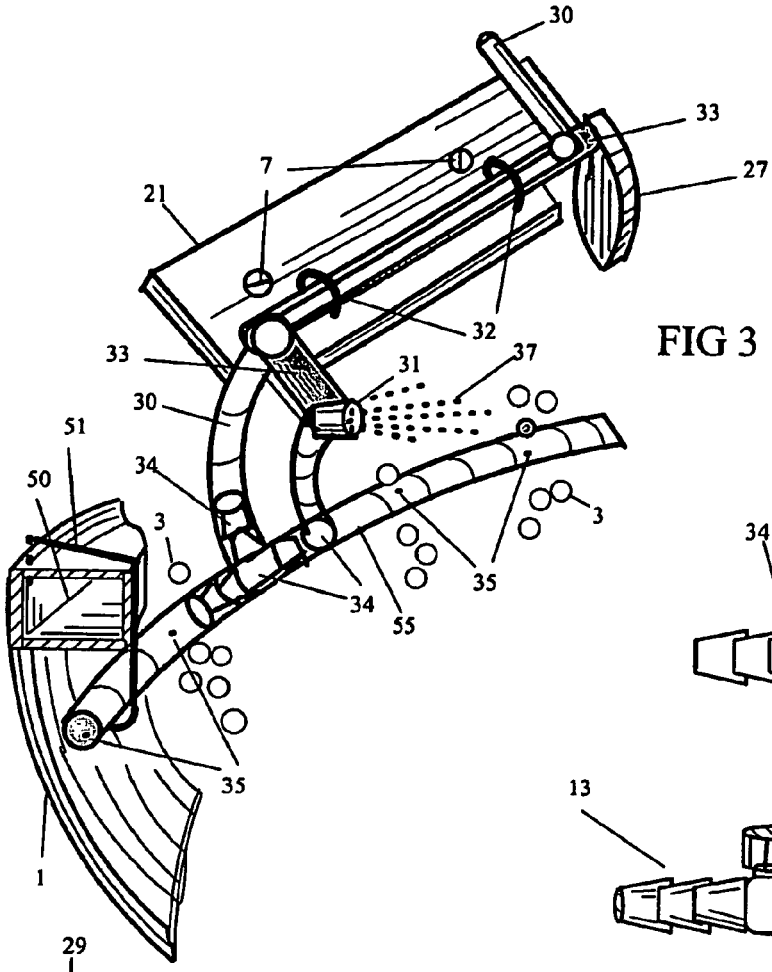
FIG. 3 sheet 2 shows the pivotable Toilet bidet (33) with a small shower head (31) and the bubbler dispenser hose (55) with bubbling holes (35). Bubbler hose is located under the toilet bowl's brim. Slow flowing soapy water with air creates continuous stream of odor blocking bubbles, intensive water flow creates a small shower(37).

Gravity and low water volume (4-10 oz/min) keeps the mixture on the bottom of the adapter, therefore air pressing out forms a continuous rich layer of bubbles (3) to block odor from escaping the bowl area (also FIG. 3).

Position of the soap container in this illustration is outside of the tank, but it could be located inside the tank, or behind the tank to be out of sight. Air pressure forces the liquid soap to exit the closed bottle trough pipe (41) trough a check valve (5B) preventing any water flowing up to the air pump or to dilute the soap mixture. Flow controller (38) limits the liquid soap amount to dripping, making this odor control system very economical. Liquid soap line (42) connects to the flexible hose with a T barbed connector(34) and water forces it into the mixing tube (22).

This invention introduces a new art, a water in-line adapter, T connector (43) with a male and a female universal bullock type threading with a preferred compression type fitting to provide and extra outlet by the toilet tank.

Figure 2:
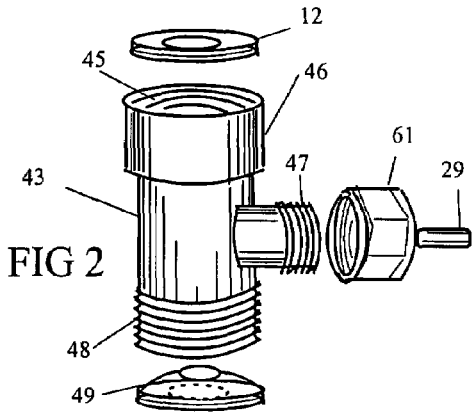
FIG. 2 shows a new type of T adapter (43) connecting to the toilet valve (10).

FIG. 2 show a close up drawing of the water inline adapter (43) providing an extra, convenient way to create an additional easy water source for toilet bidet and for the bubbler. Top end of water line adapter is bullock/toilet valve type rotatable captive threaded (45) nut (46), it connects with the toilet valve's male thread with washer (12), bottom end is a male threaded, connecting to a flexible inline water hose with washer (49).

The preferred side connection of the T adapter (47) is compression type nut (61) to provide easy connect-ability to the toilet bidet, bubbler, or for other water requirements in the bathroom area with PVC or flexible copper hose (29).

FIG. 3 sheet 2 shows the pivotable bidet's bracket (21) bidet arm(33), handle (27), flexible PVC or vinyl tube (30) conducts the soapy water with air to the flexible bubble dispenser/bidet adapter tube (55) which is attached under the rim (50) channeling the flushing water of the toilet bowl (1). Clamps (51) hold up the bubble dispenser tube connecting to hose (30) with a barbed T adapter (34). Bubble dispenser tube has 4-10 small pin size holes (35) on the bottom of the tube with the pivotable small shower/bidet head (31). To produce the odor blocking bubbles (3), small amount of diluted liquid soap exit the pin size holes with air, creating the bubbles, gravity keeps the liquid in the bottom of dispenser tube, depending on the water amount use, some bubbles may exit at the shower head (31).

For the bidet function the water flow is increased to ½ to 1 gal/min by the needle valve (20) turning the handle (39), most of the increased amount of water exist at the small bidet shower head (31) located just below the toilet lid (not shown) and some by the small bubble holes(35). Continuous bidet water can be turned off by handle (39) if rinsing is no longer required.

As an additional new art, bowl filling water from top of tank valve (10) FIG. 1 hose (15) connects to barbed connector (61) where water is flowing after flushing until tank (4) is filled and shut off by level sensor, or floating ball (9). Hose (15) has a small hole (60) as an air bleeder inside the toilet tank to disable siphoning off the tank water tank.

This is a controlled amount of bidet water flow is adjustable by flow controller (13D) as water is channeled to hose (30) and to bidet shower head (31) creating the rinsing spray (37) in the back of the toilet as the head is adjustable by tilting the bidet head (31) with bracket handle (27).

Only a small amount of pivoting rotation is needed, pivoting arm (33) held to bracket (21) by two small clamps (32), on the bottom side spring (24) keeps the bidet shower head in a normal position. Spring (24) in one end is secured or hooked to main bracket (21) at location (23) to a small arm (26) attached to the rotating pivoting arm (33).

Bidet and bubble dispenser hoses are flexible, allowing plenty of extra room for moving the bidet head into the desired position.

Figure 4:
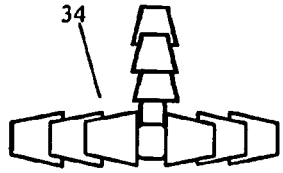
FIG. 4 shows prior art barbed connector (34), FIG. 5 prior art barbed valve (13) used.
Figure 5:
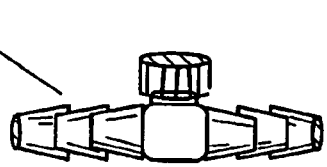

FIG. 4 shows an existing art barbed T connector (34) and FIG. 5 existing art flow volume control (13) used in this invention.

Figure 6:
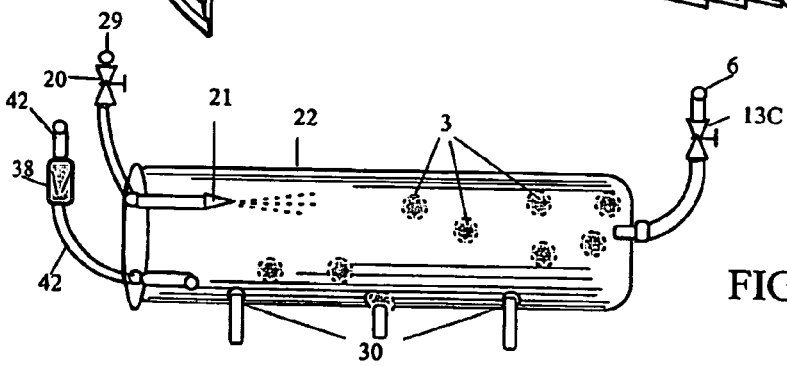
FIG. 6 shows a mixing tube(22) with water, liquid soap and air inlets and three outlets(30).

FIG. 6 shows a slightly different mixing tube(22), air intake line (6), volume adjustment (13) water intake (29), water flow control (20) with a small jet tip (21) sprays into the mixing tube to create more bubbles (3). Liquid soap enters into the tube via volume limiter (38) and this mixer has three small diameter flexible hoses to guide the bubbles into the bowl area eliminating the need for the bubbler dispenser (55) in some cases.

Figure 7:
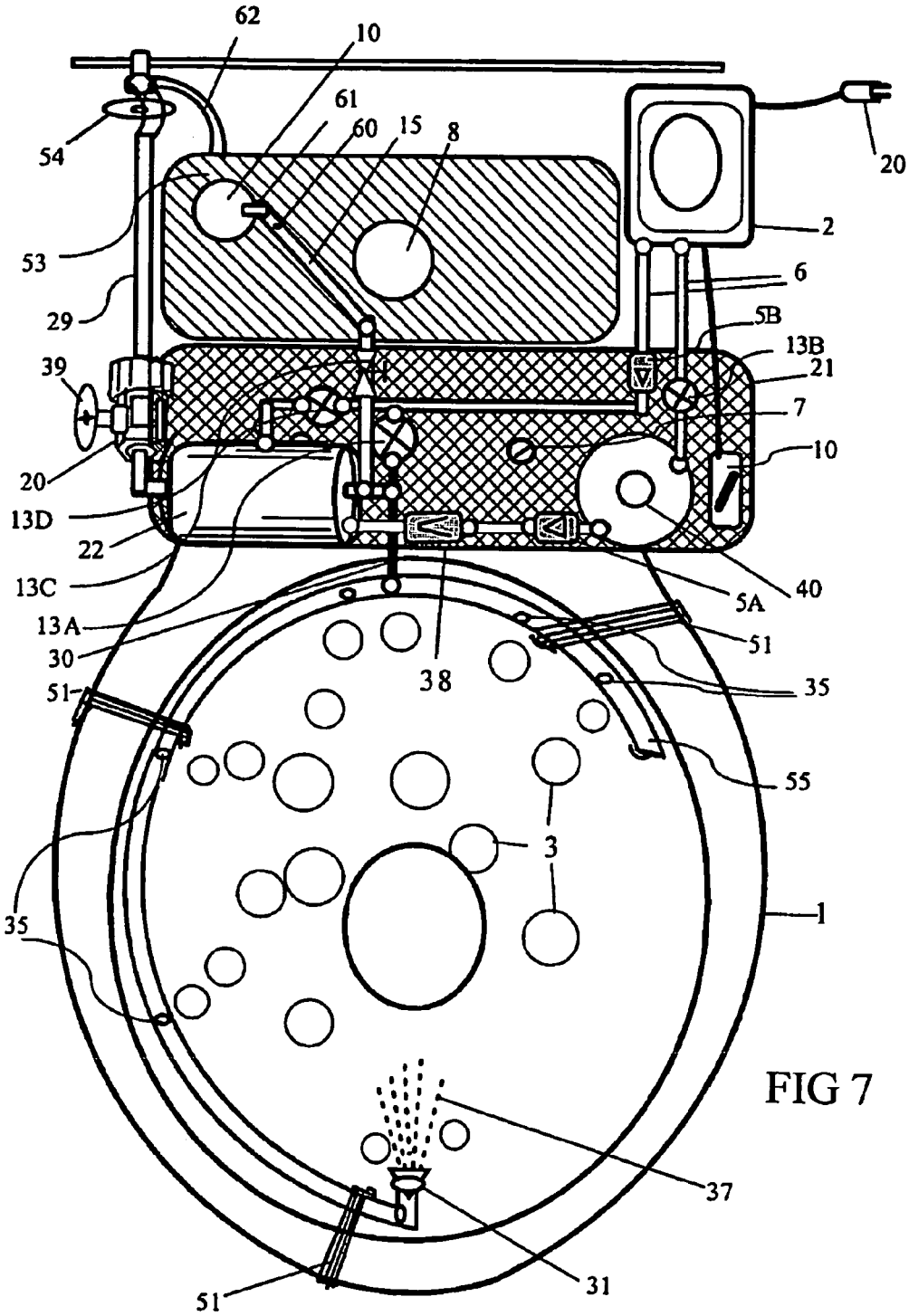
FIG. 7 on sheet 3 shows the top view of the bubbler with mixing tube (22) and liquid soap container (40) located between the toilet lid and toilet tank (not shown). Bubble dispenser line (55) with small bidet shower head(31), air pump(2), water valve (20) single hose outlet (30).

FIG. 7 shows the top view of a typical arrangement of the odor blocking/toilet bidet system. Most of the components are the same as in FIG. 1 with different arrangement, all these components can be placed in a small box, 4 W×6 L×3 H", based on design of toilet, it can be placed front of the tank, by the side, behind the tank and leaving only one small tube(30) to connect to the bubbler dispenser/bidet tube (55).

Continuous water source is provided from the main water valve (54) with dual outlet, one for the toilet valve (10), and one for the needle valve via compression fitted PVC flexible hose (29) to valve (20) to supply the odor blocking bubbler and the bidet.

Preferred location of the needle valve (20) and air pump switch (10) is on the bracket (21) which is attached to the bowl under the toilet lid screws (7) to provide solid support, other components can be located in more concealed way.

When valve (20) is slightly opened (fast dripping flow 2-6 oz/min) water enters into the mixing tube (22) approximately 2.0" long by ½" in diameter mixes with liquid soap.

When air pump (2) is turned on by switch (10), air hose (6) conducts the pressurized air trough volume control (13B), soap container (40), concentrated liquid soap is pressed out trough check valve (5A), volume reducer (38) into the mixer (22). Pressured air from air pump (2) via preferred vinyl or PVC hose (6), check valve (5B), volume control (13D) enters into the mixing tube (22) and forces the diluted soapy mixture via tube (30) into the bubble dispenser/bidet adapter (55). Slow flowing soapy water pressured by air creates a continuous stream of bubbles (3) leaving at holes (35) to cover the human excrement by several inches high to prevent odor from escaping. This dual function bubble dispenser/bidet adapter tube is a more rigid, but flexible tube used for compression fitting. Other interconnecting tubes are preferably ¼ vinyl, suitable for lower pressure barbed connection.

The bidet function is as follows: When odor-blocking function is no longer desired, water valve (20) can be fully opened as long as it is needed to provide the higher pressure/volume water, which flows all away to the bidet shower head (31) on the front of the toilet bowl below the rim to rinse off body parts to achieve the highest hygiene possible at the lowest cost.

Automatic bidet function is achieved after flashing the toilet for short rinse, or uninterrupted rinse by using valve (20). Most toilet tank valves (10) have a small hose filing the bowl (1), keeping the water flowing until the tank is filled, during this time water also flows trough the over flow pipe (8). This bowl filling water is diverted from the tank valve's barbed adapter (61) using hose (15), volume controller (13D), hose (30) than rinsing water ends up at the bidet shower head on the front end of the toilet (31).

The bubbler adapter's (55) holes are pin sized (35), low volume low pressure soapy water exits in form of bubbles, bidet head (31) is slightly elevated in relation to the rest of the adapter hose and it is attached with barbed fitting, tiltable for the desired angle. Several larger holes in the bidet head allows a generous water supply to flow trough for proper hygiene. Bubbler/bidet adapter (55) is secured inside the bowl (1) under the rim by clamps (51) preferably flexible and adjustable plastic clamp, or stainless steel. Bidet head (31) can be positioned for self-cleaning, placing it in line with the regular flushing water.

Figure 8:
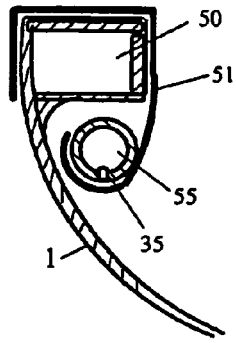
FIG. 8 on sheet 4 shows the cross section of the toilet bowls' rim area. Bubble Dispenser/Bidet adapter hose (55) is held up by clamps (51), bubble holes (35).

FIG. 8 shows a closer cross view of the top side of the toilet bowl (1) with rim (50) conducting the flushing water, clamp (51) holding up the bubbler/bidet adapter (55) and bubble holes(35).

Figure 9:
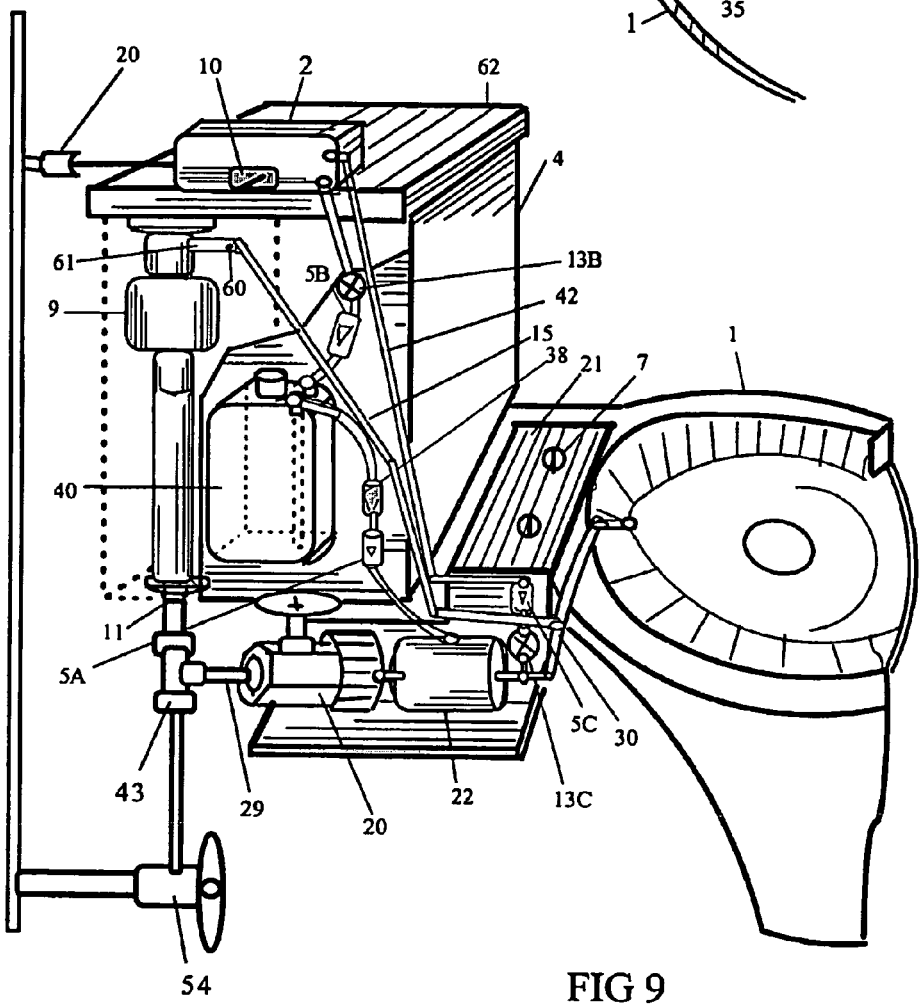
FIG. 9 sheet 4 shows a perspective view of the bubbler set up from the left side with one bubble dispensers (30), inline T connector with compression fitting (43), L shaped bracket (21) attached by two toilet lid screws (60), supporting the needle valve (20) in a convenient location just below the toilet tank (4).

FIG. 9 on sheet 4 shows left side perspective view of a typical toilet with only the odor blocking and bidet system where the water source is the new art, in-line water T diverter (43), it connects to the tank's valve at the bottom (11). The supporting bracket (21) is in an L shape, supported by the toilet lid screws (7) providing convenient and secure location for the needle valve (20).

The other components and functions of this invention are the same as on FIG. 7 or FIG. 1.

Figure 10:
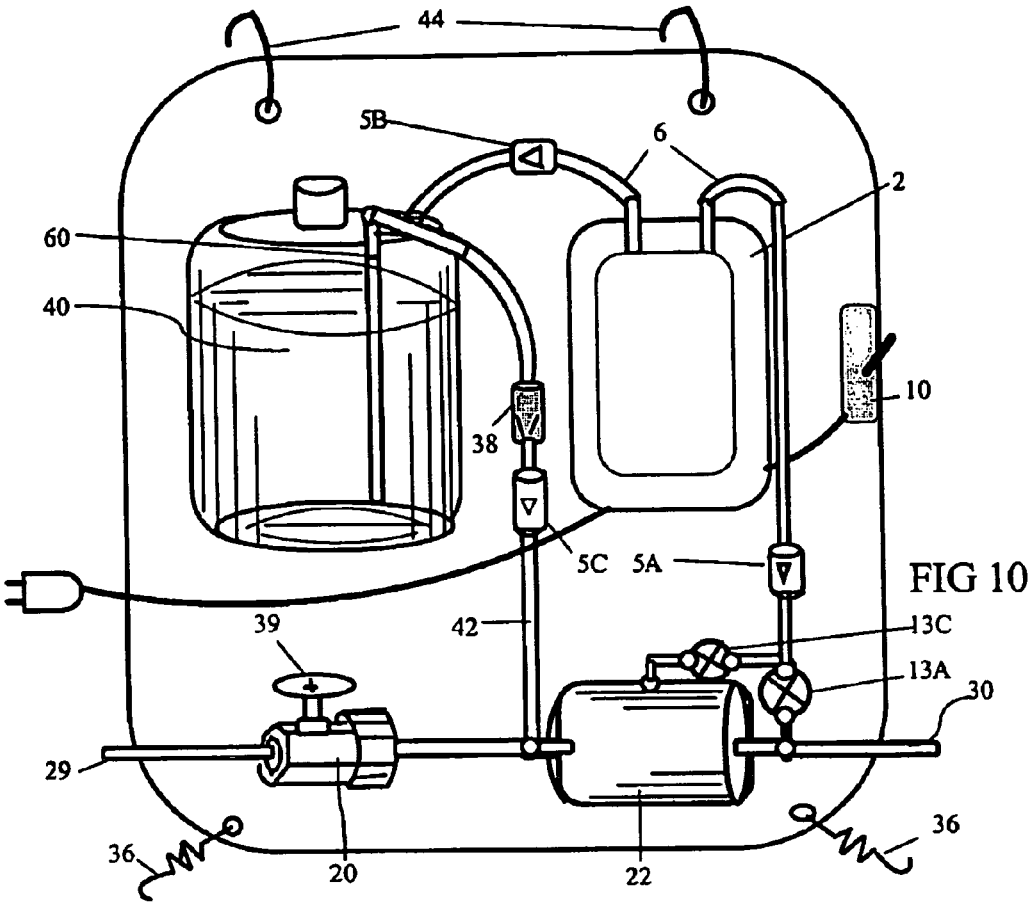
FIG. 10 shows a preferred compact arrangement of the odor blocking bubbler system preferably (cover not shown) located on the side of the toilet tank with liquid soap bottle(40), air pump(2), on off switch (10), mixing tube (22), needle water valve with compression fittings (20).

FIG. 10 sheet 5 shows a preferred arrangement of the odor blocking bubbler/bidet system in a box, with hangers (44) as it could attached to the side of the toilet tank, springs (36) can hold the bottom of the box in a steady place. Air pump (2) is turned on by switch (10), pumps the air into the soap bottle (40), liquid soap flows trough hose (42), volume limiter (38) and check valve 5C into the mixing tube (22). Water enters into the mixing tube using compression water line (29), valve (20) is turned on by handle (39), air is pumped into the mixer via check valve 5A, volume controller (13C), soapy water leaves at hose (30) with additional air trough volume control (13A) to the bubbler dispenser.

Figure 11:
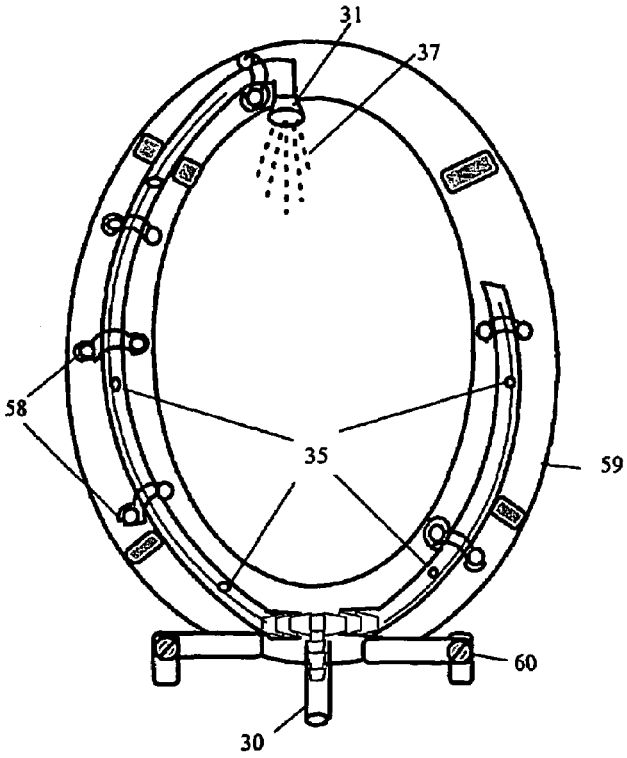
FIG. 11 sheet 6 shows the bottom of a toilet seat with bubble dispenser tubes attached by clamps (58) with bidet shower head(31).
Figure 11:
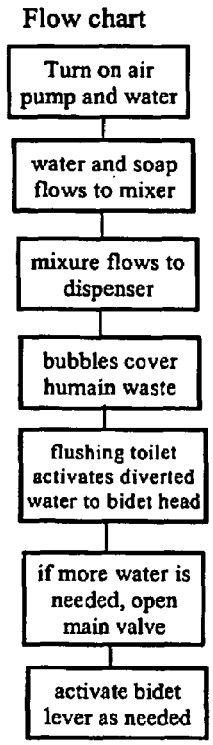

FIG. 11 sheet 6 shows the bottom of a toilet lid (59) with the bubble dispenser/bidet adapter attached to the bottom of the lid with clamps (58), bubbler holes (35), lid pivoting attachment screws (60), water line (30) communicates the water to the bidet shower head (31) to create hygienic rinsing (37).

I claim:

1. An apparatus that blocks toilet odor in a toilet by dispensing bubbles to the toilet bowl comprising:

an air pump that generates air pressure;

a water inlet that provides water;

a liquid substance capable of creating bubbles;

a mixing tube that combines the air, water and liquid substance that creates bubbles;

a tube that injects the bubbles into the toilet bowl;

a valve that controls the water pressure of the water inlet;

an elevated nozzle on the tube that injects the bubbles into the toilet bowl;

wherein a bidet function is provided by adjusting the valve to add extra water pressure that dilutes the amount of liquid substance that creates bubbles and thereby reduces the quantity of bubbles from the mixing tube resulting in mostly water exiting the elevated nozzle; and wherein the odor from the human Waste is blocked by the layer of bubbles.

2. The apparatus of claim 1 where the liquid substance capable of creating bubbles is a liquid soap.

3. The apparatus of claim 1 further comprising:

an inline water T-adapter having a captive female bullock type threading for receiving a toilet valve via a washer, a male bullock type threading on the lower end for connecting to a toilet tank hose via a second washer, and a compressure type fitting in the center to act as an extra outlet;

wherein a continuous source of water can be used to provide a continuous layer of odor blocking bubbles.

4. The apparatus of claim 1 further comprising:

an inline water T-adapter having a captive female bullock type threading for receiving a toilet valve via a washer, a male bullock type threading on the lower end for connecting to a toilet tank hose via a second washer, and a compressure type fitting in the center to act as an extra outlet;

wherein a continuous source of water can be used to provide continuous water exiting the elevated nozzle to provide the bidet function.

* * * * *